United States Patent [19]

Payerle

[11] 4,069,723

[45] Jan. 24, 1978

[54] DETENT POSITIONING DEVICE

[75] Inventor: Frank S. Payerle, Akron, Ohio

[73] Assignee: Incom International Inc., Pittsburgh, Pa.

[21] Appl. No.: 620,892

[22] Filed: Oct. 8, 1975

Related U.S. Application Data

[63] Continuation of Ser. No. 497,849, Aug. 16, 1974, abandoned.

[51] Int. Cl.[2] ..... G05G 5/06; G05G 1/00

[52] U.S. Cl. ..... 74/528; 74/548; 308/211; 74/527

[58] Field of Search ..... 74/473 R, 475, 495, 74/529, 530, 531, 535, 553, 527, 528; 308/211, 237 R, 238

[56] References Cited

U.S. PATENT DOCUMENTS

| | | | |
|---|---|---|---|
| 651,706 | 6/1900 | Forbes | 74/527 X |
| 1,064,365 | 6/1913 | Munsing | 74/475 X |
| 2,220,463 | 11/1940 | Sinclair | 74/475 X |
| 2,265,065 | 12/1941 | Daywalt et al. | 308/238 |
| 2,399,906 | 5/1946 | Bentley | 74/527 |
| 2,447,718 | 8/1948 | Simpson | 74/527 X |
| 2,553,466 | 5/1951 | Morgan | 74/527 |
| 2,573,199 | 10/1951 | Holman | 74/527 X |
| 3,164,030 | 1/1965 | Fodrea et al. | 74/475 X |
| 3,293,382 | 12/1966 | Lewandowski et al. | 74/527 X |
| 3,295,468 | 1/1967 | Belshaw | 74/527 X |
| 3,434,760 | 3/1969 | Wendler | 74/527 X |
| 3,677,096 | 7/1972 | Hatman | 74/527 |

FOREIGN PATENT DOCUMENTS

| | | | |
|---|---|---|---|
| 904,042 | 8/1962 | United Kingdom | 74/527 |

*Primary Examiner*—Samuel Scott
*Assistant Examiner*—Don E. Ferrell
*Attorney, Agent, or Firm*—James C. Wray

[57] ABSTRACT

A detent positioning device comprising a housing with a shaft rotatably mounted therein, said housing having a longitudinally extending portion with at least one recess therein so sized to accommodate a roller, a circular spring member disposed on said longitudnally extending portion engaging said roller and applying a biasing force thereto, said roller in engagement with the outer surface of said shaft, at least one longitudinally extending detent on the outer surface of said shaft in the region of said recess to accommodate a portion of said roller; said shaft being positioned relative to said housing when said detent is in alignment with said recess and said roller is biased into said detent by said spring member.

10 Claims, 4 Drawing Figures

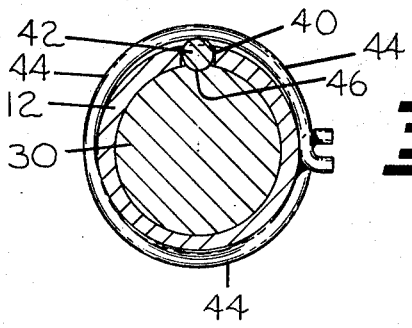
Fig. 2
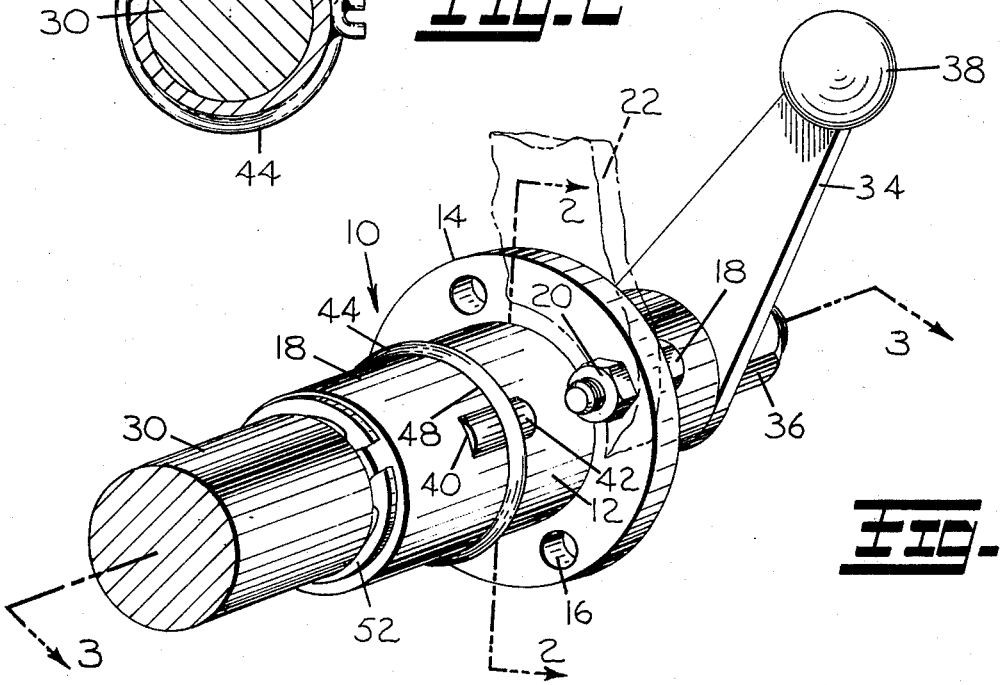
Fig. 1
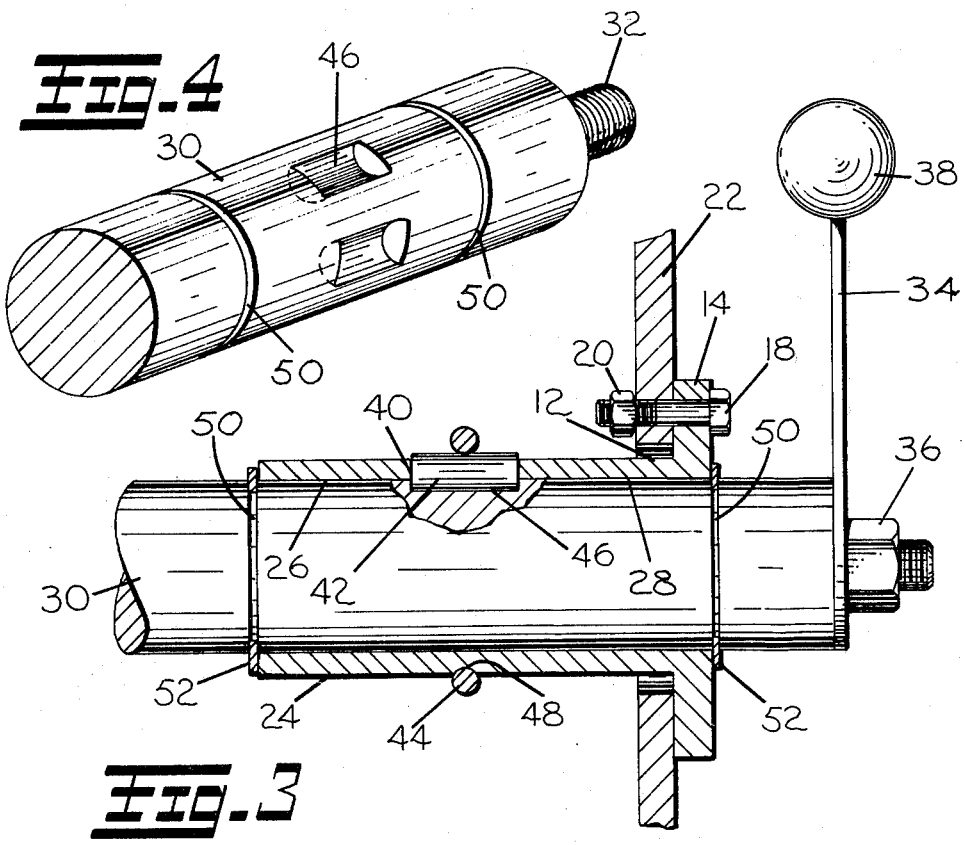
Fig. 4
Fig. 3

DETENT POSITIONING DEVICE

This application is a continuation of Serial Number 497,849 filed Aug. 16, 1974 now abandoned.

BACKGROUND OF THE INVENTION

This invention relates to detent positioning devices adapted to maintain the position of a shaft relative to a housing or the like.

In particular, the present invention relates to a detent positioning device that enables an operator of a controlled machine or apparatus to quickly position a control lever and maintain the position of that shaft.

The prior art is replete with positioning mechanisms which are typically cumbersome and complex.

Their structure and design render them unreliable, difficult to operate and expensive to manufacture.

SUMMARY OF THE INVENTION

Accordingly, it is a primary object of the present invention to provide a detent positioning device comprising a housing with a shaft rotatably mounted therein, said housing having a longitudinally extending portion with at least one recess therein so sized to accommodate a roller, a circular spring member disposed on said longitudinally extending portion engaging said roller and applying a biasing force thereto, said roller in engagement with the outer surface of said shaft, at least one longitudinally extending detent on the outer surface of said shaft in the region of said recess to accommodate a portion of said roller; said shaft being positioned relative to said housing when said detent is in alignment with said recess and said roller is biased into said detent by said spring member.

It is another object of the present invention to provide a detent positioning device capable of being inexpensively manufactured and being simplistic in design.

It is still another object of the present invention to provide a detent positioning device which is small and compact but yet effective and efficient.

It is a further object of the present invention to provide a detent positioning device which can be readily repaired and/or replaced in the field thereby reducing to a minimum the amount of downtime of its associated controlled apparatus or device.

It is yet another object of the present invention to provide a detent positioning device which can be manufactured using automated high volume techniques.

Other objects and advantages of the invention will become apparent as the present invention is better understood from the following disclosure and as shown in the accompanying drawings.

DESCRIPTION OF THE DRAWINGS

FIG. 1 is a perspective view of the detent positioning device in accordance with the present invention attached to a bulkhead which is partially cut away;

FIG. 2 is a sectional view taken along line 2—2 of FIG. 1;

FIG. 3 is a sectional view taken along line 3—3 of FIG. 1;

FIG. 4 is a perspective view of the control shaft of the detent positioning device of FIG. 1.

DESCRIPTION OF THE INVENTION

Referring now to the drawing, there is shown an improved detent positioning device embodying the concept of the present invention wherein the device is generally designated by numeral 10. The detent positioning device 10 is particularly adapted to control an apparatus or device (not shown) in a manner to be later described.

The detent positioning device 10 is provided with a housing 12 which serves several purposes. The housing may be provided with a radially extending hub 14. The radially extending hub 14 may be provided with a plurality of apertures 16 to accommodate bolts 18 threaded into nuts 20 which may be used to fasten the housing 12 to a bulkhead 22.

The housing 12 is also provided with longitudinally extending portion 24. The longitudinally extending portion 24 may be formed integral with the radially extending hub 14 or otherwise suitably fastened thereto by biasing or the like. The inner surface 26 of the longitudinally extending portion 24 along with the inner surface 28 of the radially extending hub 14 provides a bearing surface for the control shaft 30. The control shaft 30 is rotatably mounted with the housing 12 and supported by the bearing surfaces 26 and 28.

The control shaft 30 may be provided at one end with a thread portion 32 which is adapted to accept a control handle 34. The control handle 34 is fastened to the end of the control shaft by means of a nut 36 which is threaded on the threaded portion 32 and abutting the lateral face of the handle 34. The handle 34 may also be provided with a control knob 38 which is adapted to be grasped by the operator.

The longitudinally extending portion 24 is provided with at least one recess or rectangular aperture 40 which exposes a region of the shaft 30. The recess 40 is so sized to accommodate a roller 42.

The roller 42 is in contact with and is biased toward the outer surface of the control shaft 30 by a spring member 44. The spring member 44 may be configured in a shape similar to those used to secure a automobile radiator hose.

The control shaft 30 may be provided with at least one detent 46 which is so sized as to accommodate a portion of the spring biased roller 42.

The outer surface of the longitudinally extending portion 24 may be provided with a shallow annular groove 48 in which the spring member 44 is disposed to maintain the overall alignment of the spring 44 with respect to the roller 42.

The control shaft 30 may be provided with two annular grooves 50 which is adapted to receive annular snap rings 52 which maintain the axial alignment of the control shaft 30 with respect to the housing 12.

Accordingly, as the control handle 34 is moved by the operator, the control shaft 30 will correspondingly rotate to control an apparatus or device (not shown) to which it is operatively connected. This movement will be free and without restraint until the detent 46 enters the region below the recess 40. At that time the spring member 44 will bias the roller 42 into the detent. This will be inevitably felt by the operator and the roller-detent interaction will tend to inhibit the further rotation of the control shaft 30, that is, it will tend to maintain the position of the shaft 30 with respect to the housing 12.

It can be seen therefore that the operator will quickly know where a specific position or positions of the control handle is without having to look at a dial or the like. This could become important if a certain process had to be stopped at a precise time by the operator.

The degree of restraint executed by the roller 42 in the detent 46 will depend on a number of parameters such as the spring rate of the spring 44, the depth of the detent 46, the size of the roller and the like.

It should be noted that different depths could be provided for different detents 46 on the control shaft 30 which would further enhance the "feel" to the operator. For example, one detent could be deep and the other shallow, thus requiring different forces to overcome that "position".

The materials of construction of the various parts of the detent positioning device 10 could vary depending upon environment and application. It may be desirable to coat certain parts with self-lubricating plastics to enhance their operating characteristics.

Obviously, the present invention is not limited to the specific details as herein described, but is capable of other modifications and changes without departing from the scope of the appended claims.

I claim:

1. A detent positioning device comprising a housing with a shaft rotatably mounted therein, said housing having a longitudinally extending portion with at least one recess therein so sized to accommodate a single roller, a circular spring member disposed on said longitudinally extending portion engaging said roller and applying a biasing force thereto, said roller in engagement with the outer surface of said shaft, at least one longitudinally extending detent on the outer surface of said shaft in the region of said recess to accommodate a portion of said roller; said shaft being positioned relative to said housing when said detent is in alignment with said recess and said roller is biased into said detent by said spring member, said spring member being an annular circular spring encircling said longitudinally extending portion of said housing and engaging said roller at its inner annular surface, there being a control handle fixedly attached to said shaft and positioning means fixing the longitudinal position of the shaft with respect to said housing.

2. A detent positioning device in accordance with claim 1 wherein there are a plurality of detents with different depths.

3. A detent positioning device in accordance with claim 2, wherein the detents are paralleledly spaced upon a circumferential axis about said shaft.

4. A detent positioned device comprising a housing with a shaft rotatably mounted therein, said housing having a longitudinally extending portion with at least one recess extending through the portion of said housing from an inside to an outside, so sized to accommodate at least one cylindrical roller, a circular spring member disposed on the outside of said longitudinally extending portion engaging said cylindrical roller and applying a biasing force thereto, said cylindrical roller in engagement with an outer surface of said shaft, at least one axially longitudinally extending detent longer in axial direction than in a radial direction on the outer surface of said shaft in the region of said recess to accommodate a portion of said cylindrical roller; said shaft being positioned relative to said housing when said detent is in alignment with said recess and said roller is biased into said detent by said spring member.

5. A detent positioning device in accordance with claim 4 wherein there is one roller.

6. A detent positioning device in accordance with claim 5 wherein the spring member is a circular spring having a circular cross section.

7. A detent positioning device in accordance with claim 4 wherein there is one longitudinally extending detent.

8. A detent positioning device in accordance with claim 4 wherein there are a plurality of detents with different depths.

9. A detent positioning device in accordance with claim 4, wherein the spring member comprises a circular spring having a curved cross section.

10. A detent positioning device in accordance with claim 4 wherein the spring member is a circular metal spring having a round cross section.

* * * * *